US008176882B2

(12) United States Patent
Boos

(10) Patent No.: US 8,176,882 B2
(45) Date of Patent: May 15, 2012

(54) BOILER FOR COMBUSTION OF SOLID FUEL

(75) Inventor: Werner Boos, Warendorf (DE)

(73) Assignee: IHT Project GmbH, Lippstadt (DE)

( * ) Notice: Subject to any disclaimer, the term of this patent is extended or adjusted under 35 U.S.C. 154(b) by 822 days.

(21) Appl. No.: 12/267,915

(22) Filed: Nov. 10, 2008

(65) Prior Publication Data

US 2009/0120337 A1 May 14, 2009

(30) Foreign Application Priority Data

Nov. 10, 2007 (DE) ..... 10 2007 054 114

(51) Int. Cl.
*F24H 1/08* (2006.01)

(52) U.S. Cl. ..... 122/16.1; 122/211; 126/367.1

(58) Field of Classification Search ..... 122/16.1, 122/211, 22, 368, 369, 370; 126/367.1, 368.1
See application file for complete search history.

(56) References Cited

U.S. PATENT DOCUMENTS 2,592,980 A * 4/1952 Van Wert ..... 122/33
4,377,153 A * 3/1983 Flagg ..... 126/502
4,393,814 A * 7/1983 Sievert ..... 122/22
4,614,167 A * 9/1986 Bergkvist ..... 122/4 D
7,438,024 B2 * 10/2008 Bast ..... 122/16.1
2009/0107421 A1 * 4/2009 Herlt ..... 122/16.1
2009/0183693 A1 * 7/2009 Furman ..... 122/16.1

FOREIGN PATENT DOCUMENTS

EP 1 288 570 A2 3/2003

* cited by examiner

*Primary Examiner* — Gregory A Wilson
(74) *Attorney, Agent, or Firm* — Roberts Mlotkowski Safran & Cole, P.C.; David S. Safran

(57) ABSTRACT

A boiler for combustion of solid fuel, especially biomass, a first combustion stage with a primary air supply, an igniter, a fuel supply, a second combustion stage a burn-up and calcination space, a combustion chamber which is upwardly open and with a flue, the burn-up and calcination space being located underneath the combustion site such that fuel can be moved from the combustion site of the first combustion stage into the burn-up and calcination space. The primary air supply is located within the combustion chamber above the combustion site such that air can be blown into the first combustion stage, flue gases which form in the burn-up and calcination space are routed essentially passed the primary air supply means and the combustion site so that the flue gases of the second combustion stage do not adversely affect the combustion of the fuel at the combustion site.

15 Claims, 3 Drawing Sheets

BOILER FOR COMBUSTION OF SOLID FUEL

BACKGROUND OF THE INVENTION

1. Field of Invention

The invention relates to a boiler for combustion of solid fuel, especially biomass, with a boiler wall and a boiler cover, with one combustion site as the first combustion stage, with a primary air supply means, with an ignition means, with a supply means for conveyance of fuel to the combustion site, with a burn-up and calcination space as the second combustion stage, with a combustion chamber which is open to the top and with a flue, the burn-up and calcination space being located underneath the combustion site such that fuel can be moved from the combustion site into the burn-up and calcination space and further burns up or calcines there, the combustion site and the burn-up and calcination space being located jointly in the combustion chamber, and the flue adjoining the combustion chamber to the top so that the flue gases which are formed in the burn-up and calcination space burn up together with the flue gases which form over the combustion site in the flue.

In addition, the invention relates to a process for producing heat energy by burning a fuel, especially biomass, in a boiler, the fuel being burned in a first combustion stage and the fuel which has been burned up or partially burned up in the first combustion stage and which still has a portion of carbon, burning up or calcining further in the second combustion and calcination stage.

2. Description of Related Art

To produce heat energy, generally, combustible substances are burned in order to use the thermal energy obtained in doing so for heating of media. Heating takes place using a heat exchanger, for example an air-water heat exchanger, in which water is heated by the hot air which is formed when the fuels are burned. In addition to classical boilers, in which fossil fuels, such as for example petroleum, natural gas or coal are burned, there are also boilers in which renewable raw materials, especially wood in the form of chips and pellets, are used as fuels. These pellet boilers which are also called piece wood boilers are in the meantime available in a very large output range from roughly 5 to 100 kW.

Within the framework of this invention, the term "biomass" is defined as renewable raw materials. It includes not only wood, especially in the form of wood shavings, wood chips or wood pellets, but also grains as well as grain-like materials, such as rape or straw, the latter preferably in the form of rape press cake or straw pellets.

In the operation of a boiler which is designed for wood pellets with grain, a series of problems has arisen so that, in the past, operation with the same quality as with the proper fuel could hardly be achieved. The major problems here lie in poorer efficiency due to the poorer burn-up of the grain, increased emission of dirt, carbon monoxide, hydrocarbon and nitrogen oxides, by which the allowable boundary values of the boilers are often exceeded, and an increased ash content which leads to problems in ash removal and to problems from slagging.

A boiler of the type underlying the present invention is known from European Patent Application EP 1 288 570 A2. For the known boiler, in addition to the actual combustion site—the first combustion stage—there is a burn-up and calcination space as the second combustion stage in which the fuels which are only partially burned up in the first combustion stage and which still have a portion of carbon and thus still some energy value, can burn up further. Since the burn-up and calcination space is located underneath the combustion site, the fuel can easily travel from the first combustion stage to the second combustion stage by the fuel falling from the combustion site into the burn-up and calcination space.

Encapsulation of the first and second combustion stage within a common combustion chamber results in that the flue gases which form when the fuels burn up or calcine in the burn-up and calcination space and which have poorer exhaust gas values as a result of the somewhat lower temperatures prevailing there, are supplied to the flue and combustion gases which form when the fuel is burned on the first combustion stage, and burn up jointly with them within the flue in the high heat prevailing there, so that the exhaust gas values of the boiler are hardly adversely affected by the "poor" exhaust gas values from the second combustion stage.

In the known boiler, thus, not only is the efficiency increased by the energy value of the fuels being almost completely used up, but in addition the actual associated "poorer" flue gases are for the most part neutralized by these flue gases being routed through the extremely hot first combustion stage and burning further there.

In spite of all the advantages which are enjoyed by the known boiler, there are problems in adherence to future, even stricter emission values, especially when biogenic fuels which are very protein-rich are to be used.

SUMMARY OF THE INVENTION

Therefore, a primary object of the present invention is to create a boiler for combustion of solid fuels, especially of biomass, and a process for producing thermal energy by burning of biomass, in which the emission values, especially of nitrogen oxides, are further reduced in a manner as simple as possible.

This object is achieved in a boiler of the initially described type. First of all, in that the primary air supply means is made and located within the combustion chamber and above the combustion site such that, on the one hand, air can be blown into the first combustion zone, and on the other hand, the flue gases which form when the fuels burn up or calcine in the burn-up and calcination space are routed essentially past the primary air supply means and the combustion site so that the flue gases of the second combustion stage do not adversely affect the combustion of the fuel at the combustion site.

In the known boiler, the primary air supply means has an air supply channel and air nozzles which are made in a double-walled part of the combustion chamber which is used as the air channel. In this way the "poorer" flue gases from the burn-up and calcination space flow past the combustion site, but not past the air nozzles of the primary air supply means, so that the "poorer" flue gases are mixed with the air which is used as the combustion air from the air nozzles; under certain circumstances, this can lead to the flames being "smothered" at the combustion site.

It has first been recognized by the present inventor that it is advantageous if the flue gases which form as a result of the lower temperature in the burn-up and calcination space when the fuel residue burns up or calcines and which have poorer pollutant values, burn up together with the flue gases which form when the fuel burns at the combustion site within the flame tube in the high heat prevailing there. However, at the same time, the joining of the flue gases from the first combustion stage and the second combustion stage directly over the combustion site can adversely affect the combustion of the fuel at the combustion site.

The configuration and arrangement of the primary air supply means in accordance with the invention, conversely, ensures that the poorer flue gases from the second combustion stage mix only above the primary air supply means with the flue gases which form when the fuel burns at the combustion site. This ensures that the combustion air which has been blown into the first combustion zone from the primary air supply means is not adversely affected by the "poorer" flue gases from the second combustion zone so that the flames cannot be "smothered" at the combustion site by the flue gases.

The joint arrangement of the combustion site and of the burn-up and calcination space within the combustion chamber and the arrangement of the flue above the combustion chamber also ensure that the "poorer" flue gases from the second combustion stage burn up jointly with the flue gases from the first combustion stage within the flue in the high heat prevailing there.

According to one advantageous configuration of the invention, the primary air supply means has an air supply tube and a hollow body, especially a tube ring, with several air nozzles which are located above the combustion site and through which combustion air is blown into the first combustion zone. The circular ring-shaped arrangement of the air nozzles enables optimum supply of the primary air which is used as the combustion air to the combustion site. Preferably, the air nozzles are arranged in the hollow body such that air is blown in perpendicular to the combustion site at an angle of about 5° to 45°; this leads to uniform burn-up of the fuel at the combustion site which is made preferably as a combustion plate.

According to another advantageous configuration of the invention, underneath the combustion site, there is a second primary air supply means by which combustion air is supplied to the carbon-containing ash contained in the burn-up and calcination space. The second primary air supply means, preferably likewise, has an air supply tube and a hollow body with several air nozzles through which air is blown onto the glowing fuel which has burned up or partially burned up in the burn-up and calcination space.

Fundamentally, it is possible for the air supply tube of the first primary air supply means and the air supply tube of the second primary air supply means to be connected to a common fan, but it is preferable that the first primary air supply means and the second primary air supply means are each connected to its own fan. In this way, it is possible for the amount and/or pressure of the air which is being blown by the first and second primary air supply means onto the fuel at the combustion site or onto the burned-up or partially burned-up fuels in the burn-up and calcination space to be set independently of one another.

In this connection, it is especially advantageous if the boiler is assigned a measurement sensor which measures at least one exhaust gas value of the boiler, especially the residual oxygen content of the flue gases in the exhaust gas channel of the boiler, then, depending on the measured exhaust gas value the amount and/or the pressure of the air is set by the second primary air supply means. For this reason, it is possible during combustion of the fuel at the combustion site, by a correspondingly set air supply via the second primary air supply means in the second combustion stage, to produce a highly CO-containing flue gas which, without influencing combustion in the first combustion stage, burns up together with the flue gas from the first combustion stage in the high heat within the flame tube with the associated result that an increased CO content of the flue gas causes the desired reduction of the proportion of nitrogen oxides in the flue gas. Measurements have shown that, in this way, the proportion of nitrogen oxides (NOx) can be reduced to less than 500 mg/m$^3$ relative to 13% residual oxygen (reference oxygen).

According to another embodiment of the boiler in accordance with the invention, which is implemented in a boiler in accordance with European Patent Application EP 1 288 570 A2, there is a movement element in the combustion chamber which stirs the fuel at the combustion site and pushes the burned-up or partially burned-up fuel over the edge of the combustion site so that these fuel residues drop into the underlying burn-up and calcination space. This movement element at the same time prevents or at least reduces the formation of lumps of slag at the combustion site, since the fuel is continuously in motion. Moreover new fuel which is delivered via the supply means to the combustion space is mixed in under the already burning fuel; this promotes uniform combustion of the fuel.

To further optimize combustion, above the first primary air supply means, there can be a secondary air supply means which has a secondary air supply tube and several air nozzles and/or several air slots. The secondary air supply tube can be connected to the air nozzles or the air slots by the lower region of the flue which is connected to the combustion chamber being made double-walled. This double-walled region of the flue is then used as an air channel through which the secondary air flows from the secondary air supply tube to the air nozzles or air slots.

In the boiler in accordance with the invention, the formation of the above described secondary air supply means is, however, not absolutely necessary since, by way of corresponding adjustment of the amount of air via the first primary air supply means, not only can enough combustion air for combustion of the fuel located at the combustion site be made available, but moreover a sufficient secondary air supply when the volatile components burn above the combustion site, especially in the lower region of the flue, can also be ensured.

In the initially described process, the object of the invention is achieved in that the flue gases which form in the second combustion and calcination stage can be routed such that they are first routed essentially past the first combustion stage so that the flue gases of the second combustion and calcination stage do not adversely affect the combustion of the fuel in the first combustion stage, and then, are supplied to the flue gases which form in the first combustion stage and burn up jointly with them at high heat. In this way, separation of the gasification in the second combustion stage from the gasification or combustion in the first combustion stage takes place for the most part. With respect to the other advantages of the process in accordance with the invention, reference is made to the above described advantages of the boiler in accordance with the invention.

Advantageously, the process is further executed by air being blown into the first combustion zone by a first primary air supply means which is located above the combustion site at which the fuel burns. Moreover it is advantageously provided that a second primary air supply means which is located underneath the combustion site blows air onto the burned-up or partially burned-up fuel in the burn-up and calcination space. As described previously in conjunction with the boiler in accordance with the invention, in the process, the first primary air supply means and the second primary air supply means can advantageously be set independently of one another.

According to another advantageous version of the process in accordance with the invention, at least one exhaust gas value of the boiler, especially the residual oxygen content of the flue gases in the exhaust gas channel of the boiler, is measured, and depending on the measured exhaust gas value the amount and/or pressure of the air which is blown by the primary air supply means onto the burned-up or partially burned-up fuel in the burn-up and calcination space is set.

Moreover, the heat which forms in the first combustion stage and/or in the second combustion and calcination stage can be used to heat the air which is supplied to the first combustion stage and the second combustion and calcination stage.

In operation of the boiler in accordance with the invention, the amount of fuel which has been supplied by way of the supply means is set such that only the solid, degassed residual carbon which remains from the fuel drops over the edge of the combustion site into the underlying burn-up and calcination space. In doing so, the amount of combustion air which is blown through the first primary air supply means into the first combustion stage, and the size and speed of a movement element which may be present at the combustion site are taken into account and are likewise set accordingly.

During continuous combustion of the fuel at the combustion site, i.e., in the first combustion stage, in the burn-up and calcination space located underneath, by correspondingly controlled air supply by way of the second primary air supply means when the residual carbon which has fallen down glows in the second combustion stage, highly CO-containing gas is produced which is routed past the first combustion stage and then together with the flue gases which form in the first combustion stage burns up in the region of the flue with high heat. The highly CO-containing gas which originates from the second combustion stage, in doing so, causes a reduction of the proportion of nitrogen oxides in the exhaust gas of the boiler without its adversely affecting the combustion of the fuel at the combustion site.

In particular, there is now a plurality of possibilities for embodying and developing the boiler in accordance with the invention and the process in accordance with the invention. For this purpose, reference is made to the detailed description of one preferred embodiment in conjunction with the accompanying drawings.

DETAILED DESCRIPTION OF THE INVENTION

Figure 3:
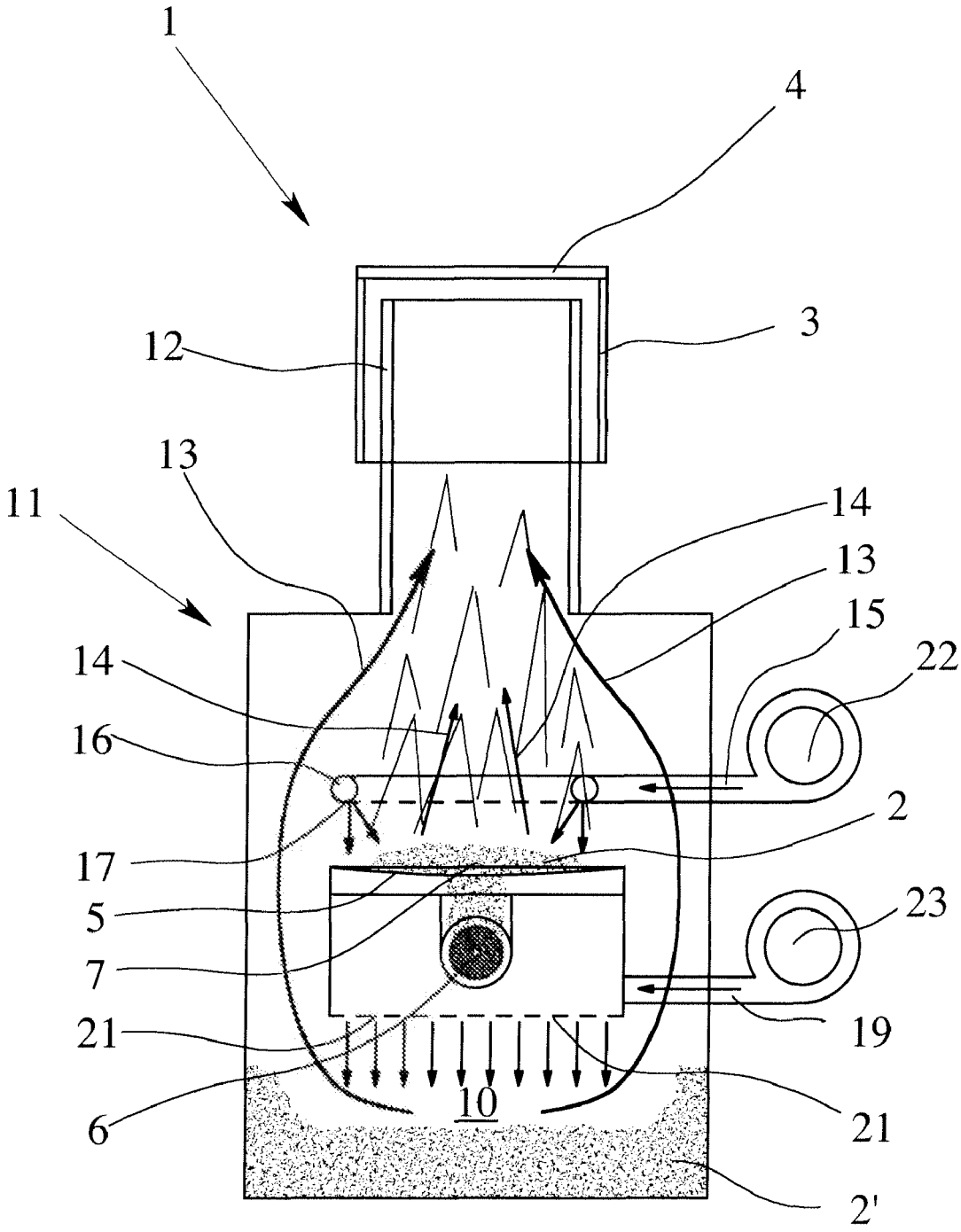
FIG. 3 is a schematic view of the internal structure of a boiler in accordance with the present invention.

The figures show a boiler 1 for combustion of solid fuel, especially of grain 2 which is shown schematically in FIG. 3, such as barley, rye, wheat or corn, and of grain-like substances, such as straw and rape. Grain will be addressed below, without the invention intending to be limited thereto.

Figure 1:
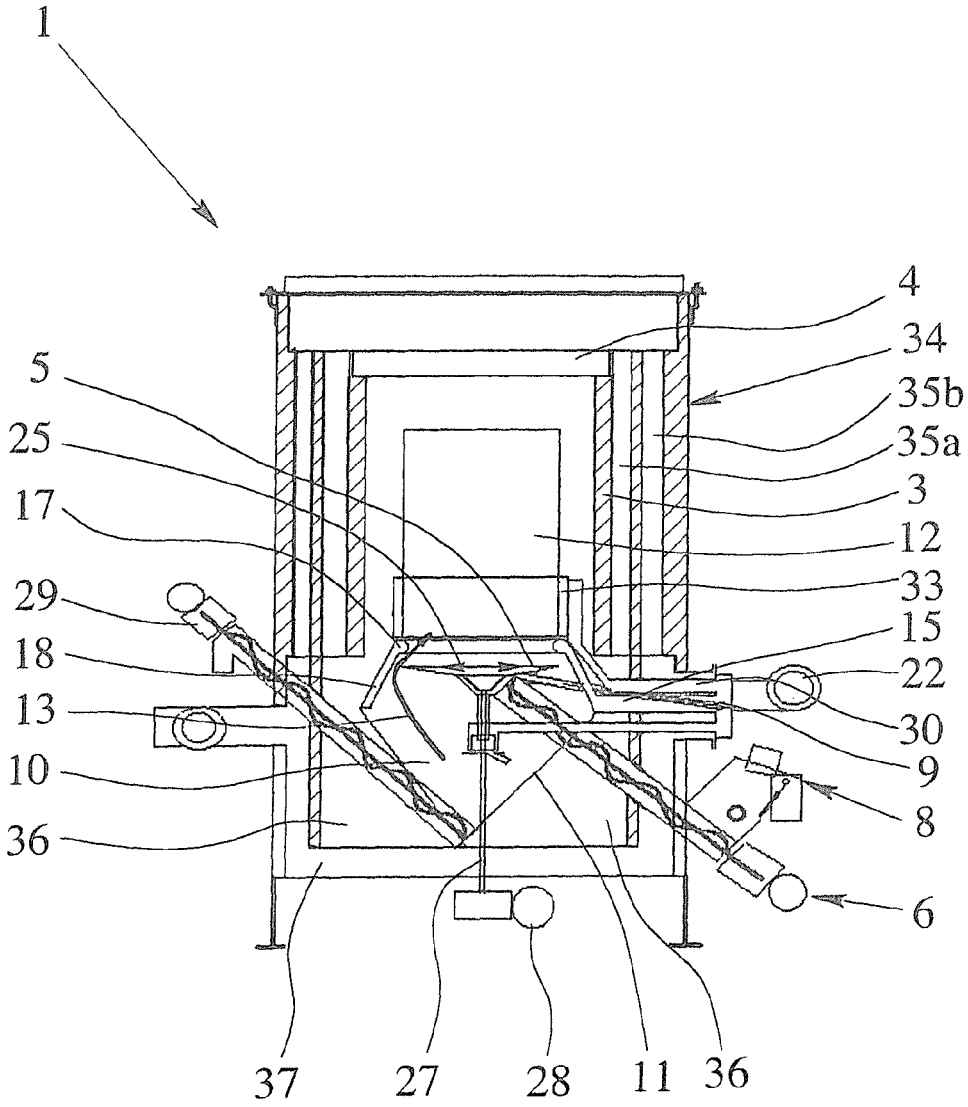
Fig. 1 (Prior Art)
FIG. 1 is a schematic sectional view of a boiler according to the prior art.
Figure 2:
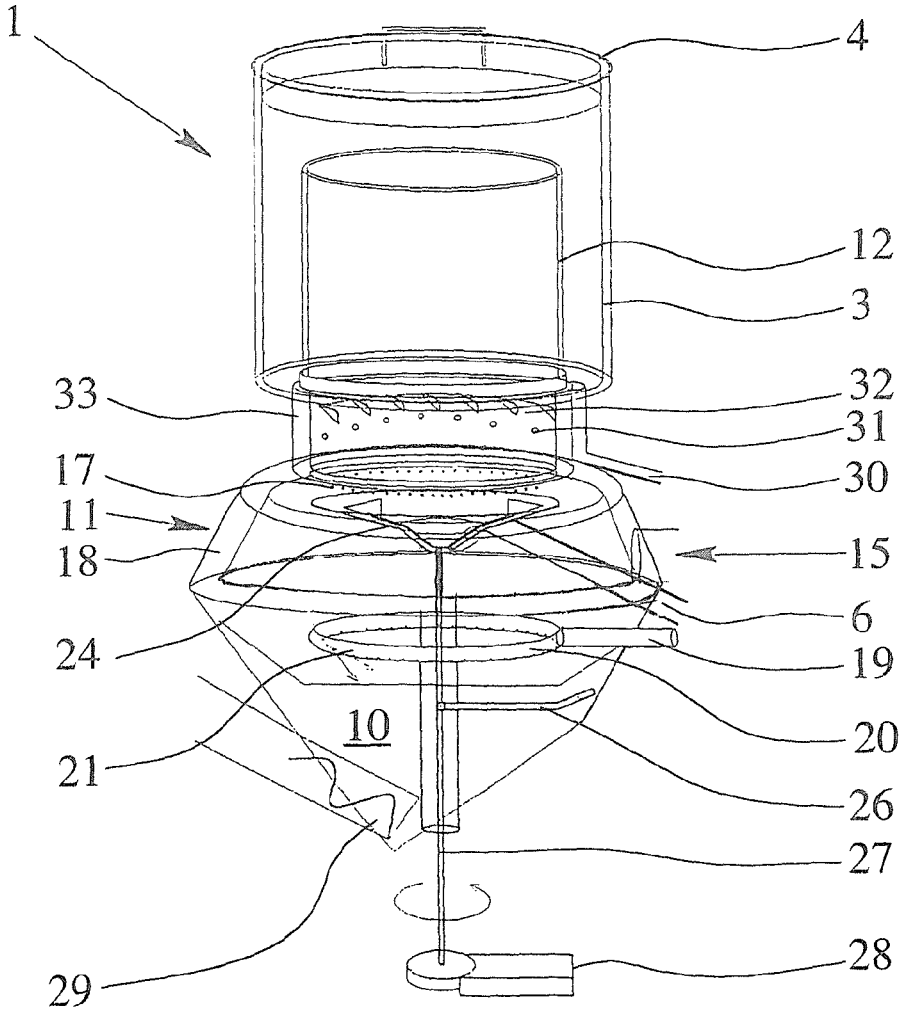
Fig. 2 (Prior Art)
FIG. 2 is a sketch of the internal structure of the boiler shown in FIG. 1.

FIGS. 1 & 2 show a boiler 1 which is known from European Patent Application EP 1 288 570 A2, while in FIG. 3 the internal structure of the boiler 1 in accordance with the invention is shown. In addition to the differences which are explained in detail below between the boiler 1 in accordance with the invention which is shown in FIG. 3 and the boiler 1 which is shown in FIGS. 1 & 2, for the boiler 1 in accordance with the invention, a plurality of features can be implemented which are shown in FIGS. 1 & 2.

The boiler 1, both as shown in FIGS. 1 & 2 as also in FIG. 3, comprises a cylindrical boiler wall 3 which is closed at the top by a round, heat-resistant and fireproof boiler cover 4. In the interior is the actual combustion site which is made as a combustion plate 5, on which the grain 2 is burned. For this purpose, the grain 2 is moved from a storage tank 8 which is located outside the boiler 1 by a supply means 6 in the form of a conveyor worm through an opening 7 made in the middle of the combustion plate 5 to the combustion site. The grain 2 which is located in the combustion site 5 is ignited using an ignition means which is made, for example, as an ignition electrode 9, the combustion air which is necessary for combustion being supplied by way of a primary air supply means which is explained below.

Underneath the first combustion stage formed by the combustion plate 5, there is a burn-up and calcination space 10 as the second combustion stage in which the burned-up or partially burned-up grain 2 which drops over the edge of the combustion plate 5 is collected. Since only the easily burnable substances from the grain 2 burn in the first combustion stage, the grain residues 2' which drop from the combustion plate 5 (shown schematically in FIG. 3) still contain carbon, and thus, also a usable portion of energy which is now being used by the grain residues 2' burning or calcining further in the burn-up and calcination space 10 with the resulting heat being used in addition to the heat which forms in the first combustion stage.

As a result of the lower temperature in the burn-up and calcination space 10, when the grain residues 2' burn or calcine there, flue gases with poorer pollutant values form, by which the exhaust gas values of the boiler 1 as a whole would be adversely affected. In order to compensate for this disadvantage which is associated with better use of the energy stored in the grain, the combustion site 5 and the burn-up and calcination space 10 are located in a common combustion chamber 11 which is upwardly open.

Both in the known boiler as shown in FIGS. 1 & 2 and also in the boiler in accordance with the invention as shown in FIG. 3, the combustion chamber 11 is connected at the top to a flue 12 so that the "poorer" combustion gases 13 which form in the burn-up and calcination space 10 together with the flue gases 14 which form over the combustion site 5 burn up at very high temperature within the flue 12 which preferably is made of a ceramic or which is lined with a ceramic. This results in the "poorer" flue gases which form when the grain residues 2' burn or calcine in the burn-up and calcination space 10 being optimally burned up. The combustion chamber 11 thus ensures encapsulation of the two combustion stages so that the "poorer" flue gases 13 of the second combustion stage do not adversely affect the exhaust gas values of the boiler 1.

In the boiler 1 in accordance with the invention shown in FIG. 3, the primary air supply means has an air supply tube 15 and a hollow body which is made as tube ring 16 in which several air nozzles 17 are formed such that the combustion air which is blown in by the primary air supply means is blown in at an angle of about 5° to 45° relative to a line that is perpendicular to the plane of the combustion plate 5 on which the grain is lying. As FIG. 3 shows, the primary air supply means, especially the tube ring 16, is located above the combustion plate 5 and spaced apart from the lower edge of the flue 12 such that the flue gases 13 which form when the grain residues 2' burn up or calcine in the burn-up and calcination space 10 are routed passed the outside of the tube ring 16 and the combustion plate 5, and thus, past the first combustion stage.

In contrast, the primary air supply means 15 of the known boiler 1 shown in FIGS. 1 & 2 directly borders the lower edge of the flue 12 so that the poorer flue gases 13 are routed out of the burn-up and calcination space 10 within the primary air supply means. For the known boiler 1, the upper region 18 of the combustion chamber 11 which partially surrounds the combustion plate 5 is made double-walled. Because the primary air supply means in the known boiler 1 is thus not located within the combustion chamber 11, but is part of the combustion chamber 11, the "poorer" flue gases 13 flow along out of the burn-up and calcination space 10 directly underneath the air nozzles 17, so that the flue gases 13 mix with the air of the primary air supply means which is being used as the combustion air. Under certain circumstances, this can lead to the flames of the grain 2 which is burning on the combustion plate 5 being smothered so that smoke can develop heavily in the first combustion stage, unintentionally.

In the configuration and arrangement of the primary air supply means in accordance with the invention shown in FIG. 3, conversely, the flue gases 13 are routed around the combustion zone with a sufficient distance so that mixing of the flue gases 13 with the combustion air which has been blown in by the air nozzles 17 in the first combustion stage does not take place.

As in the known boiler 1 as shown in FIGS. 1 & 2, in the boiler 1 in accordance with the invention shown in FIG. 3, there is a second primary air supply means in order to improve the calcination and burn-up of the grain residues 2' which are located in the burn-up and calcination space 10. The second primary air supply means likewise has an air supply tube 19 and a tube ring 20 in which several air nozzles 21 are formed by which combustion air is blown onto the grain residues 2'.

While in the known boiler 1 the air supply tube 15 of the first primary air supply means and the air supply tube 19 of the second primary air supply means are jointly connected to one fan 22, in the boiler 1 in accordance with the invention the air supply tube 19 of the second primary air supply means is connected to a second, separate fan 23. In this way it is possible to adjust the amount and pressure of the air which is blown onto the grain 2 and the grain residues 2' by the first primary air supply means and the second primary air supply means, independently of one another.

Other advantageous details of the boiler 1 are explained below, especially using FIGS. 1 & 2, and these details can also be implemented for the boiler 1 in accordance with the invention, regardless of whether they are shown in FIG. 3.

Somewhat above the combustion plate 5, there is a movement element 24 which stirs the grain 2 which is located on the combustion plate 5 and pushes the burned-up or partially burned-up grain residues 2' over the edge of the combustion plate 5 so that they drop into the underlying burn-up and calcination space 10. The movement element 24 is matched to the shape of the combustion plate 5 and on its end has triangular blades 25. In the burn-up and calcination space 10, there is a second movement element 26 which stirs the grain residues 2' which are located in the burn-up and calcination space 10 and from underneath stirs new, glowing grain residues 2' which are dropping from the combustion plate 5. In this way, on the one hand, slagging of the grain residues 2' and of the resulting ash is prevented, and on the other hand, the burned-up ash is reduced in size and thus compacted. The two movement elements 24, 26 are attached to a common shaft 27 which is driven by way of a motor 28.

The end of an ash removal worm 29 using which the burned-out ash can be automatically routed out of the boiler 1 leads into the bottom of the burn-up and calcination space 10. Different from that shown in FIG. 1, the ash removal worm 29 can also be directed horizontally instead of obliquely downward as shown.

To further optimize combustion, as shown in FIGS. 1 & 2, above the primary air supply means, there is a secondary air supply means by means of which combustion air can be additionally blown into the combustion zone in the region of the flue 12. The secondary air supply means has a secondary air supply tube 30 and several air nozzles 31 and air slots 32 through which air is blown into the flames in the flue 12. To implement the secondary supply means, the lower region 33 of the flue 12 which is connected to the combustion chamber 11 is made double-walled, yielding the advantage that the secondary air is heated by the heat prevailing in the combustion chamber 11 and in the flue 12 before it is blown into the interior of the flue 12.

FIG. 1 also shows that the boiler 1 or the boiler wall 3 and the boiler cover 4 is surrounded by an air-water heat exchanger 34 which constitutes the actual outside wall of the boiler 1. The heat exchanger 34 has several passages 35*a*, 35*b*, the flue gas flowing down at least in one passage 35*b* so that particles of dirt which rise at the same time during combustion in the flue 12, settle in the subsequent downward flow and can drop into precipitation spaces 36, 37 provided outside the combustion chamber 11. With respect to other details regarding the execution of the heat exchanger reference is made to the versions in European Patent Application EP 1 288 570 A2 in this respect.

What is claimed is:

1. Boiler for combustion of solid fuel, comprising:

a boiler wall and a boiler cover, a first combustion stage with a combustions site, a primary air supply means, an ignition means, a fuel supply means for conveyance of fuel to the combustion site, a second combustion stage with a burn-up and calcination space, a combustion chamber which is upwardly open, and a flue, wherein the burn-up and calcination space is located below the combustion site such that fuel is movable from the combustion site into the burn-up and calcination space, wherein the combustion site and the burn-up and calcination space are located jointly in the combustion chamber, wherein the flue adjoins the top of the combustion chamber so that the flue gases which are formed in the burn-up and calcination space burn up together with the flue gases which form over the combustion site in the flue, wherein the primary air supply means is located within the combustion chamber and above the combustion site so as to blow air into the first combustion stage, and wherein a flow path for the flue gases of the second combustion stage, which form when the fuels burn up or calcine in the burn-up and calcination space, is provided that routes the flue gases of the second combustion stage essentially past the primary air supply means and the combustion site so that the flue gases of the second combustion stage do not adversely affect the combustion of the fuel at the combustion site.

2. The boiler in accordance with claim 1, wherein the primary air supply means has an air supply tube and a hollow body with several air nozzles which are located above the combustion site and through which air is blown into the first combustion zone.

3. The boiler in accordance with claim 2, wherein the air nozzles are located in the hollow body such that air is blown into the combustion site at an angle of about 5° to 45° relative to a line that is perpendicular to a plane of a combustion plate on which the fuel lies at the combustion site.

4. The boiler in accordance with claim 1, wherein a second primary air supply means is provided underneath the combustion site.

5. The boiler in accordance with claim 4, wherein the second primary air supply means has a air supply tube and a hollow body with several air nozzles through which air is blown onto the burned-up or partially burned-up fuel which is located in the burn-up and calcination space.

6. The boiler in accordance with claim 5, wherein the primary air supply means and the second primary air supply means are each connected to a respective fan, and wherein at least one of the amount and pressure of the air which is being blown by the second primary air supply means onto the burned-up or partially burned-up fuel is settable independent said at least one of the amount and pressure of the air blown by the first primary air supply means into the combustion zone.

7. The boiler in accordance with claim 6, further comprising a measurement sensor which measures at least one exhaust gas value of the boiler, and wherein said at least one of the amount and pressure of the air controlled by the second primary air supply means in dependence on the measured exhaust gas value.

8. The boiler in accordance with claim 1, wherein a movement element is positioned at the combustion site so as to stir the fuel at the combustion site and push burned-up or partially burned-up fuel over the edge of the combustion site which is made as a combustion plate.

9. The boiler in accordance with claim 1, further comprising a secondary air supply means, the secondary air supply means being located above the primary air supply means and having a secondary air supply tube and several air nozzles or air slots through which air is blown into the flue gases and the flames of the burning fuel therein.

10. The boiler in accordance with claim 1, wherein the boiler wall is surrounded by a multi-pass heat exchanger, at least one of the boiler and the heat exchanger having at least one path in which the flue gases flow down, and wherein at least one precipitation space is located above the combustion chamber into which dirt particles can fall.

11. Process for producing heat energy by burning a fuel in a boiler, comprising the steps of:

burning fuel on a combustion site in a first combustion stage burning up or calcining the fuel which has been burned up or partially burned up in the first combustion stage and which still contains a portion of carbon in a second combustion and calcination stage, routing flue gases which form in the second combustion or calcination stage essentially past the first combustion stage so that the flue gases of the second combustion and calcination stage do not adversely affect the combustion of the fuel in the first combustion stage, then, supplying flue gases which form in the second combustion or calcination stage to flue gases which form in the first combustion stage, and jointly burning up the flue gases of said stages at high heat.

12. The process in accordance with claim 11, wherein air is blown into the first combustion zone by a first primary air supply means which is located above the combustion site on which the fuel is being burned.

13. Process in accordance with claim 12, wherein air is blown onto the burned-up or partially burned up fuel in the burn-up and calcination space by a second primary air supply means which is located underneath the combustion site.

14. Process in accordance with claim 13, wherein at least one exhaust gas value of the boiler is measured, and wherein at least one of the amount and the pressure of the air which is blown onto the burned-up or partially burned-up fuel in the burn-up and calcination space by the second primary air supply means is set depending on the measured exhaust gas value.

15. Process in accordance with claim 11, wherein heat which forms in at least one of the first combustion stage and the second combustion and calcination stage is used to heat the air which is supplied to the first combustion stage and the second combustion and calcination stage.

* * * * *